United States Patent [19]

Schönmeier

[11] Patent Number: 4,867,387

[45] Date of Patent: Sep. 19, 1989

[54] APPARATUS FOR ROLLING UP A WEB OF MATERIAL

[75] Inventor: Herbert Schönmeier, Düsseldorf, Fed. Rep. of Germany

[73] Assignee: Jagenberg Aktiengesellschaft, Dusseldorf, Fed. Rep. of Germany

[21] Appl. No.: 202,715

[22] Filed: Jun. 3, 1988

[30] Foreign Application Priority Data

Jun. 6, 1987 [DE] Fed. Rep. of Germany ..... 3719093

[51] Int. Cl.[4] ..... B65H 18/16

[52] U.S. Cl. ..... 242/65; 242/56.4

[58] Field of Search ..... 242/66, 67.1 R, 65, 242/56.4, 75.1, 56.5, 76

[56] References Cited

U.S. PATENT DOCUMENTS 1,738,083 12/1929 Tornberg ..... 242/75.1
4,102,512 7/1978 Lewallyn ..... 242/66
4,524,919 6/1985 Wehrmann ..... 242/67.1 R
4,550,887 11/1985 Schonmeier ..... 242/65 X
4,706,586 11/1987 Vogt et al. ..... 242/66 X

*Primary Examiner*—John M. Jillions
*Attorney, Agent, or Firm*—Herbert Dubno

[57] ABSTRACT

An apparatus for rolling or winding up a web of material with a driven supporting roll on which one or more winding rolls contact during the winding process and with a plurality of press rolls pressable on the circumference of one of the winding rolls which are mounted substantially parallel to the supporting roll axis on an end of at least one upwardly pivoting lever mounted laterally adjacent the supporting roll. The press roll pairs are each mounted on the end of a pivoting lever and their rotation axes are movable about one axis substantially parallel to the longitudinal direction of the pivoting lever. Advantageously the press roll pair is also supported movable about a third axis which is approximately perpendicular to the longitudinal shaft of the pivoting lever and extends perpendicular to the rotation axes. Also the pivoting lever can be variable in its length.

8 Claims, 2 Drawing Sheets

APPARATUS FOR ROLLING UP A WEB OF MATERIAL

FIELD OF THE INVENTION

My present invention relates to an apparatus for rolling or winding up a web of material, especially a paper sheet.

BACKGROUND OF THE INVENTION

An apparatus for rolling or winding up a web of material can have a driven supporting roll on which one or more winding rolls rest during the winding process and a plurality of press rolls pressable against the circumference of one of the winding rolls, which are mounted pairwise parallel to the axis of the supporting roll on an end of at least one lever mounted laterally adjacent the supporting roll and pivotable upwardly.

This apparatus is used especially for rolling or winding up longitudinally-divided webs of paper. They have one or more winding stations on both sides of the peak line of the supporting roll. The individual webs made by the longitudinal cutting are fed alternately to winding stations on both sides (of the supporting roll). The winding stations comprise two winding frames or brackets suspended on crossbars movable transversely to the web on which a holder with a guide head extending downwardly is attached for insertion in a winding tube.

During the winding process, each winding roll is held between two guide heads.

To wind with a new tube and to influence the roll hardness by the pressing force of the winding roll bearing on the supporting roll, a pivoting lever with two press rolls which are pressable on the circumference of the winding roll is mounted laterally adjacent the supporting roll.

A winding apparatus of this type is described in German Patent 31 02 894. In this apparatus the press roll pairs are mounted on an end of pivoting levers which are attached to raisable and lowerable longitudinal supports on both sides of the supporting roll. The press roll pairs are pressed at the beginning of the rolling or winding process against the winding roll. The upwardly pivotable press rolls are moved into an upper position before removal of the full winding roll after the end of the winding process.

Press roll pairs as described in German Patent 20 60 758 are mounted pivotally on the free end of a pivoting lever. By this mount, the press rolls can be swung about an axis parallel to its rotating axis to avoid any excess or non-uniform pressure by the press rolls against the winding roll.

Disadvantageously, a uniform winding or rolling up over the width of a winding roll is not guaranteed so that included folds can occur inside the winding roll.

OBJECTS OF THE INVENTION

It is an object of my invention to provide an improved apparatus for winding or rolling up a web of material which avoids the above mentioned disadvantages.

It is another object of my invention to provide an improved apparatus for winding or rolling up a web of material which provides a more uniform rolling or winding over the width of a winding roll.

SUMMARY OF THE INVENTION

These objects and others which will become more readily apparent hereinafter, are attained in accordance with my invention in an apparatus for rolling or winding up a web of material with a driven supporting roll on which one or more winding rolls contact during the winding process and with a plurality of press rolls pressable against the circumference of at least one of the winding rolls, which are mounted pairwise parallel to the axis of the supporting roll on an end of at least one lever attached laterally adjacent the supporting roll pivotable upwardly.

According to my invention, a press roll pair on an associated pivoting lever is supported so as not only to be movable about each of their longitudinal rotation axes but also about a second axis that is approximately parallel to the longitudinal direction of the pivoting lever.

It has been shown that a variable roll hardness and inclined folds can occur as a result of nonuniform linear pressing of the press rolls. By the movable mounting of the press roll pair according to my invention and as described above, a very uniform linear pressing is guaranteed even when the winding rolls are not exactly cylindrical.

The rotation axes of the press roll pair can additionally be supported so that the press roll pair can be movable about a still further third axis which extends approximately perpendicular to the longitudinal direction of the pivoting lever and perpendicular to the press roll longitudinal rotation axes. Thus the press rolls an fit on or be adjusted in a second plane which extends approximately tangentially to the supporting roll surface.

The pivoting lever can be variable in length allowing an adjustment to the pressing position on the winding roll of increasing diameter. This fitting of the pivoting lever to the winding roll of increasing size can be assisted by a spring which presses apart two parts of the pivoting lever attached to each other slidably and which together form the pivoting lever. Essentially then the pivoting lever is spring-loaded.

The pivoting lever can be pivotally mounted on a carriage which is slidable on a cross piece transverse to the sheet. Thus the position of the press rolls can be adjusted to the center of different width winding rolls. A piston-and-cylinder unit can be attached to the carriage and the pivoting lever. This unit can function as a drive for the pivoting motion. Also the cross pieces are movable until above the winding station having the winding roll. Thus the pivoting lever with its mount can be raised for removal of a full roll.

BRIEF DESCRIPTION OF THE DRAWING

The above and other objects, features and advantages of my invention will become more readily apparent from the following highly diagrammatic description, reference being made to the accompanying highly diagrammatic drawing in which.

DESCRIPTION

Figure 1:
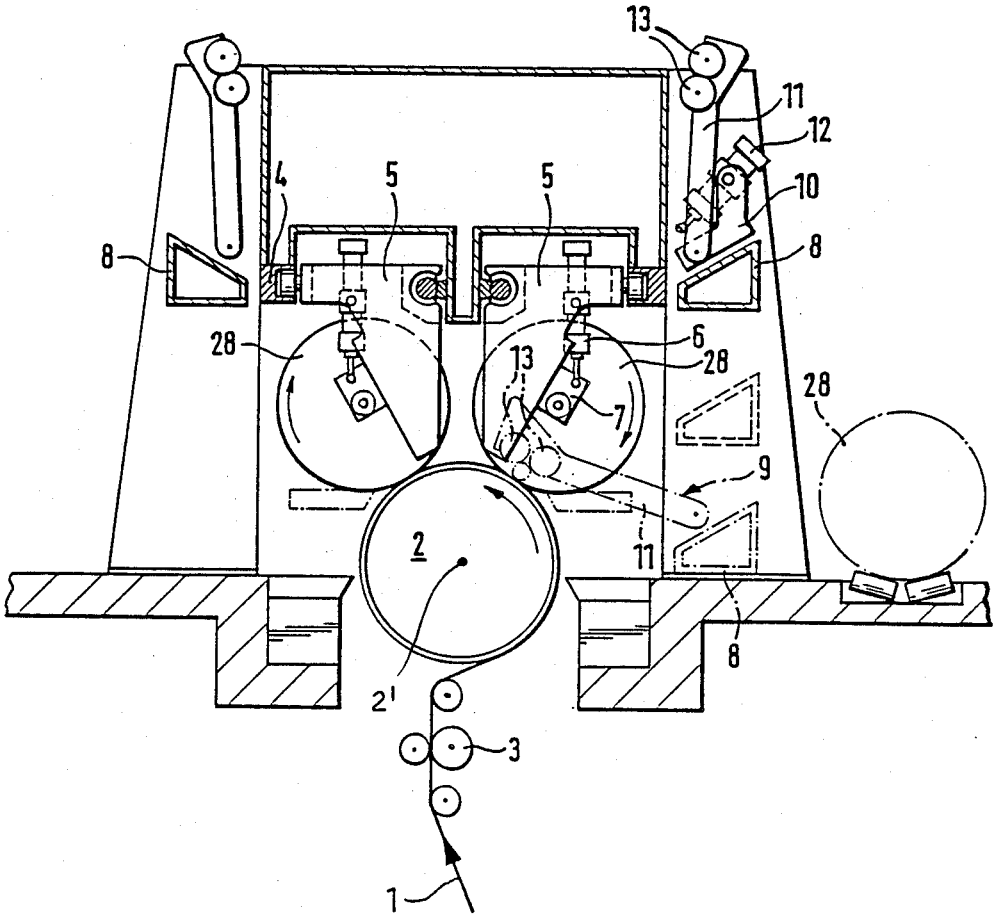
FIG. 1 is a cross-sectional view through an apparatus for rolling up a web of material according to my invention.

The winding apparatus has a driven horizontally mounted supporting roll 2 to which the paper web 1 is fed from below through the circular knife 3 which divides the web longitudinally.

Winding stations 5 are suspended above the supporting roll 2 on both sides of the peak line of the supporting roll 2 on substantially horizontal crossbars 4 which extend over the entire working width of the apparatus.

Each winding station 5 is formed from two roll brackets movable independently of each other parallel to the supporting rolls axis 2' on which is attached a carriage guide 6 that extends downwardly. Each carriage guide 6 supports a carriage 7 with a guide head for insertion in the winding tube.

On both sides beside the supporting roll 2, the substantially horizontal cross pieces 8 extending over the working width of the apparatus are attached to the base frame of the apparatus adjustable in regard to height. Press roll stations 9 are mounted movable transverse to the feed direction on the base frame.

Each press roll station 9 comprises a press roll carriage 10 movable on the cross piece 8, a pivoting lever 11 pivotally mounted on it, a pivot drive 12 and a press roll pair 13 rotatably mounted on the free end of the pivoting lever 11. For each winding station 5 a press roll station 9 is located on the appropriate side of the supporting roll 2.

Figure 2:
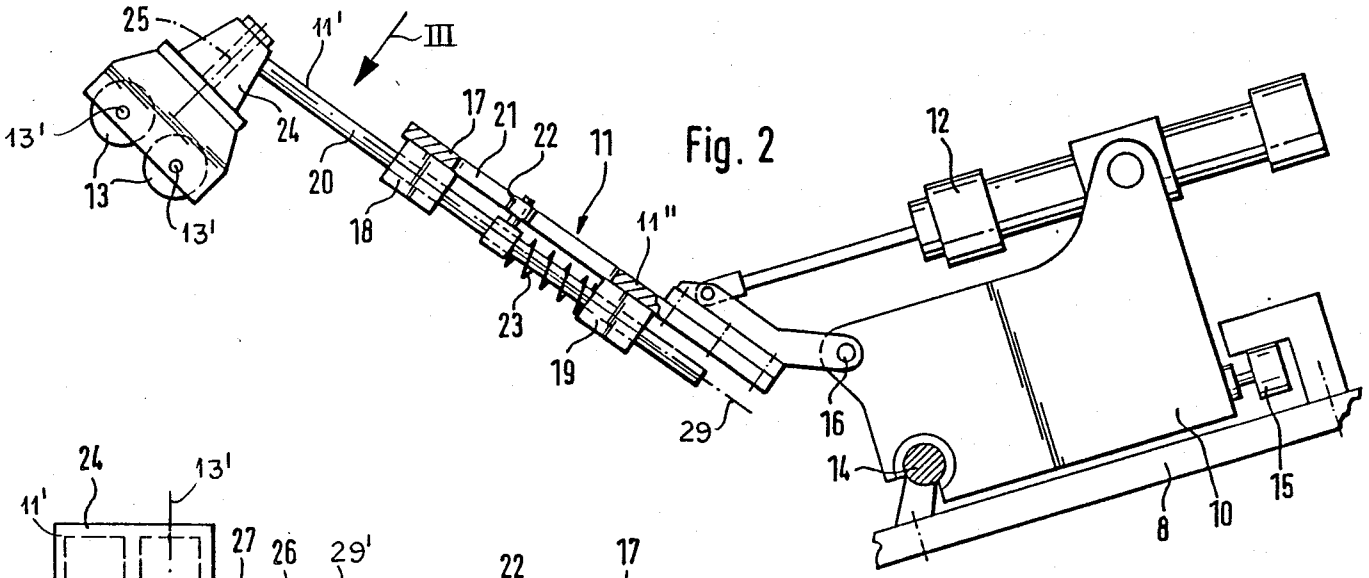
FIG. 2 is a cross-sectional view showing a pivoting lever with a press roll pair and their mounting upon the apparatus according to FIG. 1.
Figure 3:
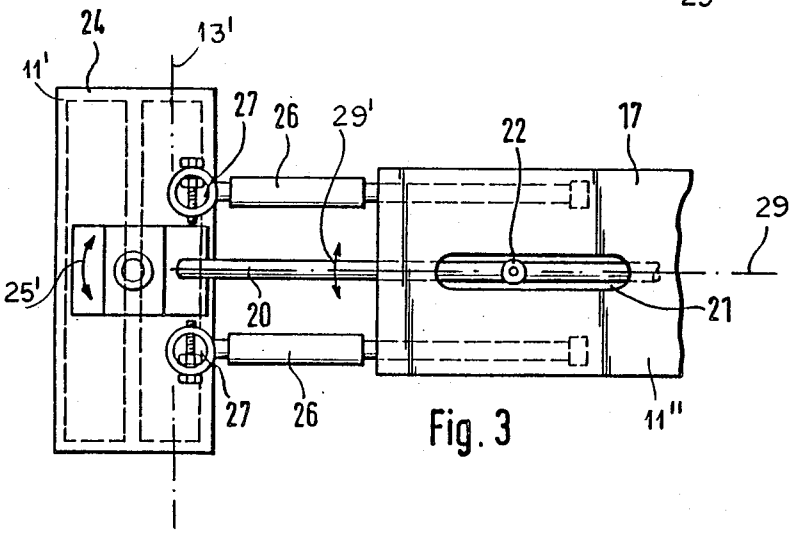
FIG. 3 is a top-plan view on the device shown in FIG. 2 in the direction of the arrow III.

The structure of a press roll station 9 is explained more clearly with reference to FIGS. 2 and 3.

The press roll carriage 10 has a round guide member 14 on the side attached to the cross piece 8 and a running roller 15 for transverse travel on the cross piece 8.

On its upper portion, the pivoting lever 11 is pivotally mounted on a pivot 16 on the side which is facing the supporting roll 2. The drive for swinging the lever up and down comprises a piston-and-cylinder unit 12 which is attached both to the pivoting lever 11 and also the pivoting roll carriage 10.

The pivoting lever 11 comprises two parts 11', 11'' which are slidable relative to each other in the longitudinal direction: an arm 17 pivotally connected to the carriage 10 to which two circular guides 18, 19 are attached spaced from each other and a shaft 20 which is guided rotatable about one axis 29 in both circular guides 18, 19.

The arm 17 has an elongated slot 21 in which a runner or wheel 22 attached to the shaft 20 runs with lateral play and thus both the longitudinal displacement of the shaft 20 relative to the arm 17 and its rotary motion about axis 29 are bounded.

A spring 23 is located between the circular guides 18 and 19. Its spring force is chosen so that on putting the pivoting lever 11 into its lowered position, the shaft 20 with the press rolls 13 is pressed outwardly, i.e. from the carriage 10. On pivoting the pivoting lever 11 into its upward position the shaft 20 is moved into its opposite position by the increasing vertical weight components, i.e. the effective length of the pivoting lever is reduced.

A frame 24 is located at the free end of the shaft 20, in which both rubber press rolls 13 are rotatably mounted with rotation axes 13' parallel spaced from each other a certain distance. The frame 24 with the press rolls 13 is movable pivotally about another axis 25 which extends approximately perpendicular to shaft 20 and perpendicular to the rotation axes 13' of the press rolls 13. A shock absorber 26 is attached to both upper sides of the shaft 20 to the upper side of the frame 24 and to the supporting arm 17 parallel to the shaft 20. These shock absorbers damp the axial motion of the shaft 20 and the parts attached to it.

The rotational motion about the other axis 25 is bounded additionally by guide member 27 with the lateral bearing surfaces on the upper side of the frame 24. The frame 24 with the press rolls 13 can pivot by the above described suspension both about the center axis 29 of the shaft 20 bounded by the play of the wheel or runner 22 in the slot 21 and also about the axis 25 by the bearing surfaces of the guide members 27. These motion possibilities allow the press roll pair 13 in a respective frame to adjust to uneveness in the winding roll 28 and to compensate for manufacturing inaccuracies in its mounting.

The apparatus according to my invention functions as follows:

To wind up a new roll, an empty tube is pressed by the press roll 13 on the supporting roll 2 and held there. After a new web beginning was glued on, the winding roll 28 positioned displaced on it is put in rotation by rotation of the supporting roll 2 and the winding proceeds. Since the weight of the winding roll 28 is not sufficient for the desired linear force at the beginning stage of the winding process, it is pressed additionally with the press roll 13 against the supporting roll 2. Since the diameter of the winding roll 28 increases on rolling up, the press roll 13 pivots back accordingly so that the press pressure of the drive is reduced. On swinging up, the pivoting lever 11 shortens automatically. When the winding roll 28 has attained a diameter of about 400 mm, the pivoting lever 11 swings up with the press rolls 13. After the end of the winding process —with a winding roll diameter of about 1500 mm —the cross pieces 8 travel up into a region which allows the lateral removal of the completed roll 28.

I claim:

1. In an apparatus for rolling up a web of material with a driven supporting roll on which at least one winding roll rests during a winding process and with a plurality of press rolls pressable against a circumference of said winding roll, each of the press rolls having a longitudinal rotation axis, a lever having a longitudinal dimension and supported laterally adjacent said supporting roll , means mounting the lever for pivotable movement upwardly the press rolls being mounted pairwise parallel to the axis of said supporting roll on one longitudinal end of said lever, the improvement wherein said lever includes means supporting said press rolls for movement about a second axis approximately parallel to the longitudinal dimension of said pivoting lever.

2. The improvement defined in claim 1 wherein said press roll pair are additionally supported so as to be movable about a third axis which extends approximately perpendicular to said longitudinal dimension of said pivoting lever and perpendicular to said longitudinal rotation axes.

3. The improvement defined in claim 1 wherein said pivoting lever is variable in length.

4. The improvement defined in claim 3 wherein said pivoting lever comprises two parts longitudinally slidable relative to one another and has a spring which opposes a shortening of said pivoting lever.

5. The improvement defined in claim 1 wherein said pivoting lever is pivotally mounted on a carriage which is slidable on a cross piece transverse to said web.

6. The improvement defined in claim 5 wherein a piston-and-cylinder unit is attached to said carriage and said pivoting lever, said unit operating as a drive for a pivoting motion of said lever.

7. The improvement defined in claim 5 wherein said cross piece is movable until it is located above the winding roll.

8. An apparatus for rolling or winding up a web of material comprising:

a driven supporting roll;

one or more winding rolls on which said supporting roll contact during the winding process;

at least one pivoting lever mounted laterally adjacent at least one of said winding rolls pivotable upwardly and comprising two parts attached to each other slidably and spring-loaded so that said pivoting lever has a variable length;

at least one carriage which is slidable on at least one cross piece transverse to said web on which at least one of said pivoting levers is mounted;

a piston-and-cylinder unit attached to said carriage and said pivoting lever, said unit operating as a drive for a pivoting motion; and at least one press roll pair pressable against a circumference of one of said winding rolls mounted pairwise on an end of at least one of said pivoting levers, each of said press rolls in said pair having a longitudinal rotation axis which is parallel to an axis of said supporting roll, said press roll pair being supported movable on said pivoting levers about a second axis approximately parallel to the length of said pivoting lever and additionally supported movable about another axis which extends approximately perpendicular to said length of said pivoting lever and perpendicular to said longitudinal rotation axes.

* * * * *